US006439291B1

(12) United States Patent
Amin-Javaheri

(10) Patent No.: US 6,439,291 B1
(45) Date of Patent: Aug. 27, 2002

(54) FOAMED PLASTIC DOOR WITH SLATTED VANE CONSTRUCTION

(75) Inventor: Hossein Amin-Javaheri, Houston, TX (US)

(73) Assignee: KAM Technology Holdings Inc., Houston, TX (US)

( * ) Notice: Subject to any disclaimer, the term of this patent is extended or adjusted under 35 U.S.C. 154(b) by 0 days.

(21) Appl. No.: 09/755,212

(22) Filed: Jan. 5, 2001

(51) Int. Cl.[7] ..... E05D 15/26
(52) U.S. Cl. ..... 160/213; 160/229.1
(58) Field of Search ..... 160/229.1, 206, 160/199, 377, 379, 213; 52/473

(56) References Cited

U.S. PATENT DOCUMENTS 3,985,175 A 10/1976 Pukl
4,169,180 A * 9/1979 McDonagh ..... 428/215
5,099,903 A * 3/1992 Chen ..... 160/199
5,163,260 A * 11/1992 Ricard et al. ..... 52/473
5,301,735 A * 4/1994 Chen ..... 160/199
5,630,305 A * 5/1997 Hlasnicek ..... 52/518
5,634,998 A * 6/1997 Schiedegger et al. ..... 52/473 X
5,778,958 A * 7/1998 Stebner ..... 160/210
5,996,298 A * 12/1999 Wenzlaff et al. ..... 52/473
6,161,354 A * 12/2000 Gilbert et al. ..... 52/520

* cited by examiner

*Primary Examiner*—David M. Purol
(74) *Attorney, Agent, or Firm*—Shook, Hardy & Bacon L.L.P.

(57) ABSTRACT

Extruded foamed plastic doors having two side stiles and a top and bottom rail forming a generally rectangular configuration and having horizontal vanes covering the interior of the door. The stiles have indentations along their interior edge for receiving the vanes and holding the vanes in a permanently fixed position relative to the stiles and rails when the stiles and rails are assembled into a rectangular configuration.

6 Claims, 2 Drawing Sheets

FOAMED PLASTIC DOOR WITH SLATTED VANE CONSTRUCTION

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

This invention relates to doors made from extruded foamed plastic. More specifically, it relates to bi-fold doors or half doors made from extruded foamed plastic, such as polyvinyl chloride (PVC). The side stiles, horizontal rails, and slatted vanes that make up the door are individual solid pieces that are formed by extruding foamed plastic through a die. The invention contemplates that the door be assembled in a manner similar to that used for a conventional wooden door.

2. Description of the Related Art

Traditionally, bi-fold doors or half doors have been made of wood, but the expense of wood has caused the industry to search for other suitable materials. Recently, manufacturers have turned to fabricating such doors from synthetic resins by injection molding, as described in U.S. Pat. No. 3,985,175. However, the injection molding process is limited in its application. Typically, the injection molding process involves making two rectangular hollow pans and joining the pans together by the edges to form a hollow door. U.S. Pat. No. 3,985,175 describes a particular type of construction wherein a front face is made of injection molded plastic and has reinforcing members on the back side but no back face. Such a construction, while serving to maintain rigidity, provides a door having only one good side. Such a door is unsuited for general applications in the home or office.

One of the main problems with full length doors made from injection molded plastic is their lack of rigidity. Therefore, there is a need in the industry for a plastic door that has sufficient rigidity and is aesthetically pleasing from both sides.

SUMMARY OF THE INVENTION

Full length bi-fold and half doors may be constructed from foamed plastic, such as PVC, that is extruded to form the various pieces used to construct the door. Foamed plastic has the advantage of being as light as wood because the air within the plastic decreases the density of the plastic. More importantly, however, this type of construction material offers several advantages over wood. A foamed plastic door is much more fire resistant than wood. Furthermore, foamed plastic material does not warp from humidity. Additionally, the finished product manufactured from plastic does not require painting and is a solid color throughout so scratches from ordinary use are not readily visible. Finally, foamed plastic can be made with color variations and can be embossed with a wood grain finish so it is as aesthetically pleasing as wood.

DETAILED DESCRIPTION OF INVENTION

The invention is directed to full length bi-fold and half doors constructed from synthetic resinous, foamed plastic that is extruded to form the various pieces used to make the door. Foamed plastic has the advantage of being almost as light as wood because the entrapped air within the plastic decreases the density of the plastic. However, this type of construction offers several advantages over wood. A foamed plastic door is much more fire resistant than wood. Furthermore, foamed plastic material does not warp from humidity. Additionally, the finished product manufactured from plastic does not require painting and is a solid color throughout so scratches from ordinary use are not readily visible. Also, foamed plastic can be made with color variations and can be embossed with a wood grain finish so it is as aesthetically pleasing as wood. Finally, the raw material cost of the plastic is significantly less than the cost of wood.

Figure 1:
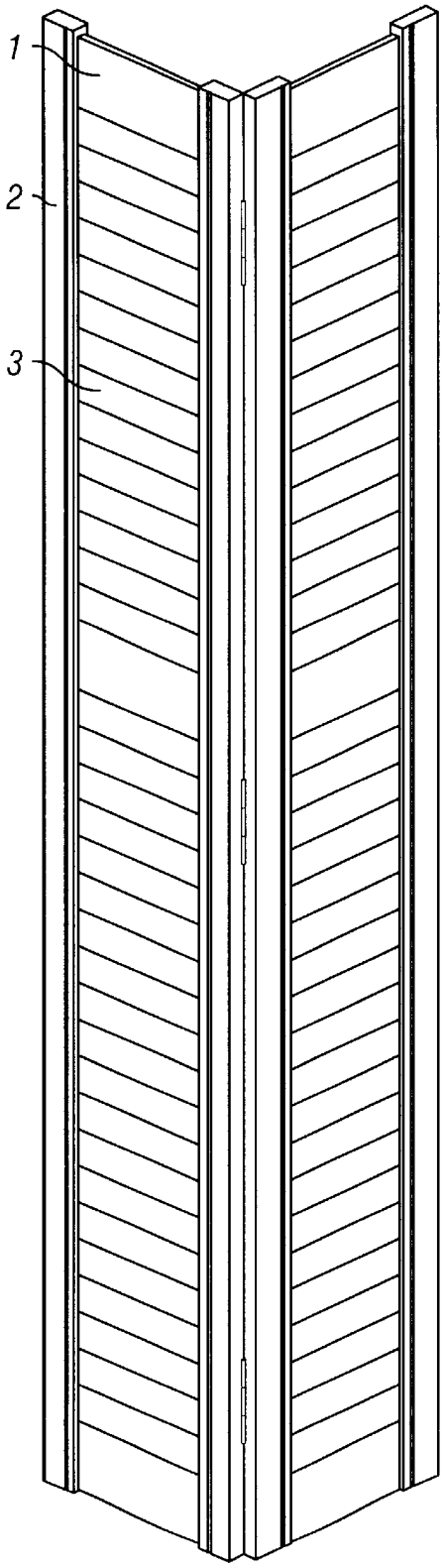
FIG. 1 is a schematic representation of a bi-fold door in accordance with the present invention.
Figure 2:
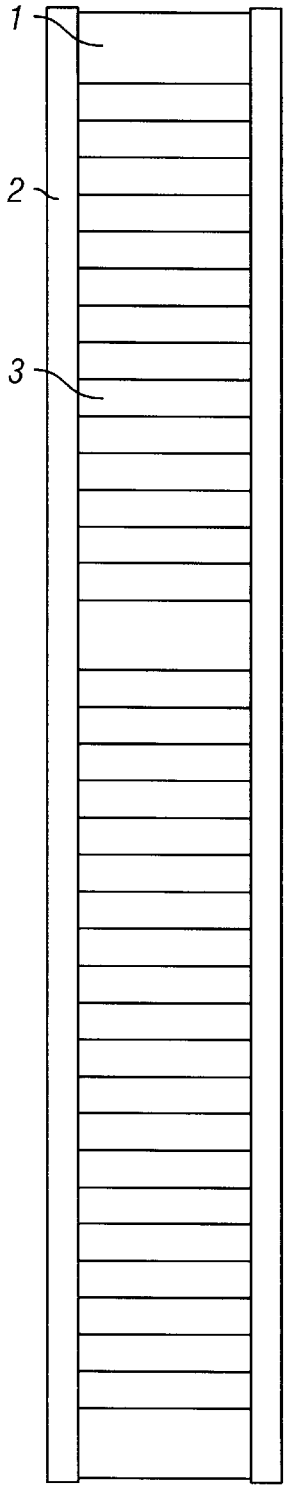
FIG. 2 is a schematic representation of a half door in accordance with the present invention.

FIG. 1 and FIG. 2 show the preferred embodiment of the invention wherein extruded foamed plastic bi-fold and half doors have two side stiles 2 and a top and bottom rail 1 forming a generally rectangular configuration and have horizontal vanes 3 covering the interior of the door. The stiles 2 have mating cutouts 4 formed along their interior edge for receiving the vanes 3 and holding the vanes 3 in a permanently fixed position relative to the stiles 2 and rails 1 when the stiles 2 and rails 1 are assembled into a rectangular configuration. Preferably, the door also has a middle rail of the same or similar configuration as the top and bottom rails 1. This middle rail provides extra stability for the door and also provides a means for attaching an opening mechanism, such a knob.

Figure 3:
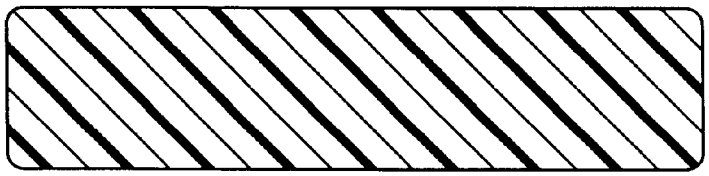
FIG. 3 is a cross-section view of a rail used for the top, middle and bottom horizontal support members.

The basis extrusion process is old and well known to a person skilled in the art. Various dies may be used to extrude the individual pieces with a variety of profiles, but FIG. 3 shows the preferred cross-section view of a rail used for the top and bottom of the horizontal rail section. Furthermore, the individual pieces may be given any desired color variation during the extrusion process and may be embossed with any given grain pattern to make the final product as aesthetically pleasing as wood.

Figure 4:
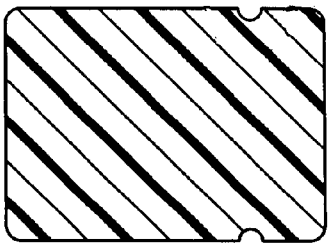
FIG. 4 is a cross-section of the side support members or stiles.

FIG. 4 shows the preferred construction of the side stiles. This construction also allows for hardware, such as hinges, to be securely attached. Of, course, other designs are acceptable so long as they provide the needed strength and rigidity.

Figure 5:
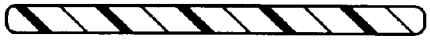
FIG. 5 is a cross-section of a slatted vane that fits between the side stiles.

FIG. 5 shows the preferred construction of the slatted vanes that cover the interior of the door. These vanes are basically solid and are designed to fit into the side stiles in a permanently fixed position when the door is fully assembled. The slatted vanes allow light and air to pass through the door yet provide a high degree of privacy. Because the vanes are somewhat flexible, an individual vane may be removed from the door and replaced with a new vane, if the need arises, without disassembling the door.

The stiles and rails may be fastened together by any suitable means, such as glue or screws, and the rails or stiles may be dovetailed to fit into a mating configuration on the adjoining piece. The preferred method of construction is a screw fastener. For aesthetic purposes, the screws should be countersunk so that the heads can be covered with a plug to make the assembly virtually invisible.

The hinges associated with mounting the bi-fold or two piece door could be standard metal hinges that attach to the stiles with screws. The density and strength of foamed plastic is similar to wood so there is no problem with attaching hardware directly to the door. Additionally, the part of the stile to which the hinge attaches may be notched so that the flat part of the hinge fits flush with the side of the stile.

The preferred plastic material is PVC because of its strength, durability, and ease of extruding. However, other suitable materials, such as polyethylene and polypropylene could be used. The preferred formulation of PVC is about 65% to 75% PVC, about 6% to 10% calcium carbonate, about 15% to 21% comprising a stabilizer, lubricant, process aid, impact modifier, pigment and titanium dioxide, and about 1% to 3% foaming agent. The especially preferred formulation is about 70% PVC, about 8% calcium carbonate, about 18% stabilizer, lubricant, process aid, impact modifier, pigment and titanium dioxide, and about 2% foaming agent. Uniroyal's commercial product AZRV is an example of a foaming agent. Other ingredients include a tin stabilizer, a paraffin wax lubricant, such as XL165, a process aid, such as methyl methacrylate which is commercially available as K-120N from Rohm & Haas, and an impact modifier, such as modified acrylic available as D-200 from Elf-Autochem. Titanium dioxide should be added in an amount sufficient to impart the desired shade of white, and pigment may be added to achieve other color variations.

This invention is directed mainly toward bi-fold and halfdoors, rather than full doors, because the vanes in a bi-fold and half door are relatively short and will maintain their structural integrity if pressure is applied on the vanes when the door is in use. However, this invention could be made to work well on a full size door by using a center stile that would permit the use of short vanes on both sides of the center stile. Without a center stile on a full size door, the foamed plastic vanes covering an expanse of about two feet would tend to be too flexible and would probably not be suitable. However, if the vanes were made thicker or wider, they could be made to work on a larger expanse. The obvious disadvantage of this configuration would be the expense of the extra material needed to make the vanes and the additional weight of the door.

As is apparent from the foregoing description, there are various modes of carrying out the invention. It is to be fully understood that all of the foregoing is intended to be merely illustrative and is not to be construed or interpreted as being restrictive or otherwise limiting of the present invention.

I claim:

1. A synthetic resinous plastic door comprising two panels, each having a generally rectangular configuration with two vertical side stiles, and a top and bottom horizontal rail defining the perimeter of each panel, and vanes covering the interior of the rectangular configuration, the stiles having mating cutouts along their interior edge for receiving the vanes so as to hold the vanes in a permanently fixed position relative to the stiles and rails when the stiles and rails are assembled into a rectangular configuration, and the stiles, rails and vanes being formed by extruding foamed plastic which comprises about 65% to 75% polyvinyl chloride, about 6% to 10% calcium carbonate, about 15% to 21% stabilizer, lubricant, process aid, impact modifier, pigment and titanium dioxide, and about 1% to 3% foaming agent, wherein the two panels of the door are attached to each other by a hinge to permit folding of the door and one of the panels is attached to a door frame by a hinge.

2. The door of claim 1 wherein the foamed plastic comprises about 70% polyvinyl chloride, about 8% calcium carbonate, about 18% stabilizer, lubricant, process aid, impact modifier, pigment and titanium dioxide, and about 2% foaming agent, wherein the two panels of the door are attached to each other by a hinge to permit folding of the door and one of the panels is attached to a door frame by a hinge.

3. A synthetic resinous plastic door comprising two panels, each having a generally rectangular configuration comprising two vertical side stiles, and a top and bottom horizontal rail defining the perimeter of the door, and vanes covering the interior of the rectangular configuration, the stiles having mating cutouts along their interior edge for receiving the vanes so as to hold the vanes in a permanently fixed position relative to the stiles and rails when the stiles and rails are assembled into a rectangular configuration, and the stiles, rails and vanes being formed by extruding foamed plastic which comprises about 65% to 75% polyvinyl chloride, about 6% to 10% calcium carbonate, about 15% to 21% stabilizer, lubricant, process aid, impact modifier, pigment and titanium dioxide, and about 1% to 3% foaming agent, wherein the two panels of the door are each attached to a door frame by a hinge to permit the panels to open from the middle.

4. The door of claim 3 wherein the foamed plastic comprises about 70% polyvinyl chloride, about 8% calcium carbonate, about 18% stabilizer, lubricant, process aid, impact modifier, pigment and titanium dioxide, and about 2% foaming agent.

5. A synthetic resinous plastic door having a generally rectangular configuration comprising two vertical side stiles, and a top and bottom horizontal rail defining the perimeter of the door, a vertical center stile and vanes covering the interior of the rectangular configuration, the stiles having mating cutouts along their interior edge for receiving the vanes so as to hold the vanes in a permanently fixed position relative to the stiles and rails when the stiles and rails are assembled into a rectangular configuration, and the stiles, rails and vanes being formed by extruding foamed plastic, wherein the foamed plastic comprises about 65% to 75% polyvinyl chloride, about 6% to 10% calcium carbonate, about 15% to 21% stabilizer, lubricant, process aid, impact modifier, pigment and titanium dioxide, and about 1% to 3% foaming agent.

6. The door of claim 5 wherein the foamed plastic comprises about 70% polyvinyl chloride, about 8% calcium carbonate, about 18% stabilizer, lubricant, process aid, impact modifier, pigment and titanium dioxide, and about 2% foaming agent.

* * * * *